US010227217B2

(12) United States Patent
Cveykus et al.

(10) Patent No.: US 10,227,217 B2
(45) Date of Patent: Mar. 12, 2019

(54) ADJUSTABLE GRAVITY-DRIVEN LIFTING DEVICE

(71) Applicant: Kenco Corporation, Ligonier, PA (US)

(72) Inventors: Gregory A. Cveykus, Johnstown, PA (US); Josh Mastruserio, Irwin, PA (US); Anthony Freidhoff, Johnstown, PA (US)

(73) Assignee: Kenco Corporation, Ligonier, PA (US)

( * ) Notice: Subject to any disclaimer, the term of this patent is extended or adjusted under 35 U.S.C. 154(b) by 0 days.

(21) Appl. No.: 15/683,211

(22) Filed: Aug. 22, 2017

(65) Prior Publication Data

US 2018/0050888 A1 Feb. 22, 2018

Related U.S. Application Data

(60) Provisional application No. 62/377,978, filed on Aug. 22, 2016.

(51) Int. Cl.
*B66C 1/42* (2006.01)
*B66C 1/44* (2006.01)

(52) U.S. Cl.
CPC ..... *B66C 1/442* (2013.01); *B66C 1/422* (2013.01)

(58) Field of Classification Search
CPC ..... B66C 1/30; B66C 1/422; B66C 1/442
USPC ..... 294/63.1, 100.1, 100.2, 118, 119
See application file for complete search history.

(56) References Cited

U.S. PATENT DOCUMENTS 834,271 A * 10/1906 Dale
2,020,823 A * 11/1935 Callahan ..... B65G 7/12 294/103.1
2,816,793 A * 12/1957 Elberty ..... B66C 1/485 294/106
2,874,990 A * 2/1959 Janoff ..... B66C 1/422 294/110.2
3,172,694 A * 3/1965 Bradley ..... B66C 1/485 294/119
3,248,145 A * 4/1966 Diamond ..... B66C 1/64 294/110.1
3,455,593 A * 7/1969 Moro ..... B66C 1/422 294/110.1
3,561,812 A * 2/1971 Dixon ..... B66C 1/442 294/110.1
4,336,962 A * 6/1982 Read ..... B66C 1/442 294/106
5,364,147 A * 11/1994 Dickey ..... B66C 1/422 294/117
6,012,752 A 1/2000 Douglas
6,331,025 B1 12/2001 Douglas
8,303,006 B2 * 11/2012 Wall ..... B66C 1/422 294/110.1

FOREIGN PATENT DOCUMENTS

WO WO-8602340 A1 * 4/1986 ..... B66C 1/442

* cited by examiner

*Primary Examiner* — Dean J Kramer
(74) *Attorney, Agent, or Firm* — Alan G. Towner; Leech Tishman Fuscaldo Lampl

(57) ABSTRACT

A lifting device is disclosed in which tong arms are coupled to parallel laminated horizontal spine members that slide in opposition to each other via input of force from the tong arms. The horizontal spine members are coupled to load-engaging feet to transfer the force of the tong members to a given load. The horizontal spine members include teeth or the like along a horizontal axis for engagement and indexing of the load-engaging feet.

15 Claims, 13 Drawing Sheets

ADJUSTABLE GRAVITY-DRIVEN LIFTING DEVICE

CROSS-REFERENCE TO RELATED APPLICATION

This application claims priority from U.S. Provisional Application No. 62/377,978 filed Aug. 22, 2016, which is incorporated herein by reference.

FIELD OF THE INVENTION

The present invention provides a device for lifting a variety of objects, and more particularly relates to a device configured to transfer clamping force along a horizontal axis as well as a method of adjusting the device.

BACKGROUND INFORMATION

Various types of lifting devices are used for lifting objects such as logs, pipes, debris, concrete highway barriers, rocks and the like. For example, U.S. Pat. No. 6,012,752 to Douglas describes a concrete pipe lifting apparatus with a lockable and releasable scissor grip structure. U.S. Pat. No. 6,331,025 to Douglas describes a barrier lifter apparatus having a scissor structure with L-shaped clamping elements.

SUMMARY OF THE INVENTION

The present invention provides a lifting device in which tong arms are coupled to a spine assembly comprising parallel laminated horizontal members that slide in opposition to each other via the input of force from the tong arms. The horizontal spine members are further coupled to load engaging feet, thus transferring the force of the tong arms to the given load. The horizontal spine members include teeth or the like along a horizontal axis for the engagement and indexing of the load-engaging feet. The load-engaging feet include a lever, switch or the like for engaging a tooth block in each foot with the opposing teeth of the horizontal spine members.

In accordance with embodiments of the invention, the lifting device comprises a tong style body unit comprising two tong tines or arms pivotally joined by a central axis, each tong arm joined to an upper link at one end, and each upper link joined together by a pin or shaft along with a lifting bail or hook at the opposite end. A cyclic latching mechanism may be affixed to either an upper link, the lift bail or the link pin itself, and a receiving member corresponding to the latching mechanism may be affixed to a tong element, or the central pivot pin or shaft itself. A laminated spine assembly comprises outer spine elements having a provision for the engagement of a locking member along a horizontal edge that is joined to the output end of one of the tong assemblies, and an inner spine element having a provision for the engagement of a locking member along a horizontal edge that is joined to the output end of the opposing tong assembly. Two horizontally mobile foot assemblies, each comprising plate members laterally joined by crossing members perpendicular to the plane of the plate members, encase the spine elements to provide a freedom of movement along the horizontal axis of the spines. Means are provided for locking each of the foot assemblies to either the inner or outer horizontal members respectively via the engagement mechanism. A load-engaging pad is provided on each foot to engage and clamp the object to be lifted.

Each pad may pivot in relation to its respective foot, and may be made of any suitable material such as urethane, gripping teeth, and the like.

An aspect of the present invention is to provide a lifting device comprising a lifting hook, first and second upper arms comprising ends pivotally connected to the lifting hook, and lower ends, first and second lower arms having upper ends pivotally connected to the lower ends of the first and second upper arms, a central pivot bolt pivotally connecting the first and second lower arms together at intermediate regions thereof, and lower ends movable toward and away from each other when the first and second arms rotate in relation to each other around the central pivot bolt, a spine assembly supported by the lower ends of the first and second lower arms, and outer and inner feet mounted at different positions along a length of the spine assembly and comprising pads structured and arranged to grip objects to be lifted by the lifting device, wherein the spine assembly comprises outer and inner spine bars slidably movable in relation to each other along the length of the spine assembly when the lower ends of the first and second lower arms moved toward and away from each other, the outer foot is releasingly securable to the outer spine bar, and the inner foot is releasingly securable to the inner spine bar, whereby the sliding movement of the outer and inner spine bars in relation to each other causes the outer and inner feet to move in relation to each other along the length of the spine assembly.

This and other aspects of the present invention will be more apparent from the following description.

DETAILED DESCRIPTION

Figure 1:
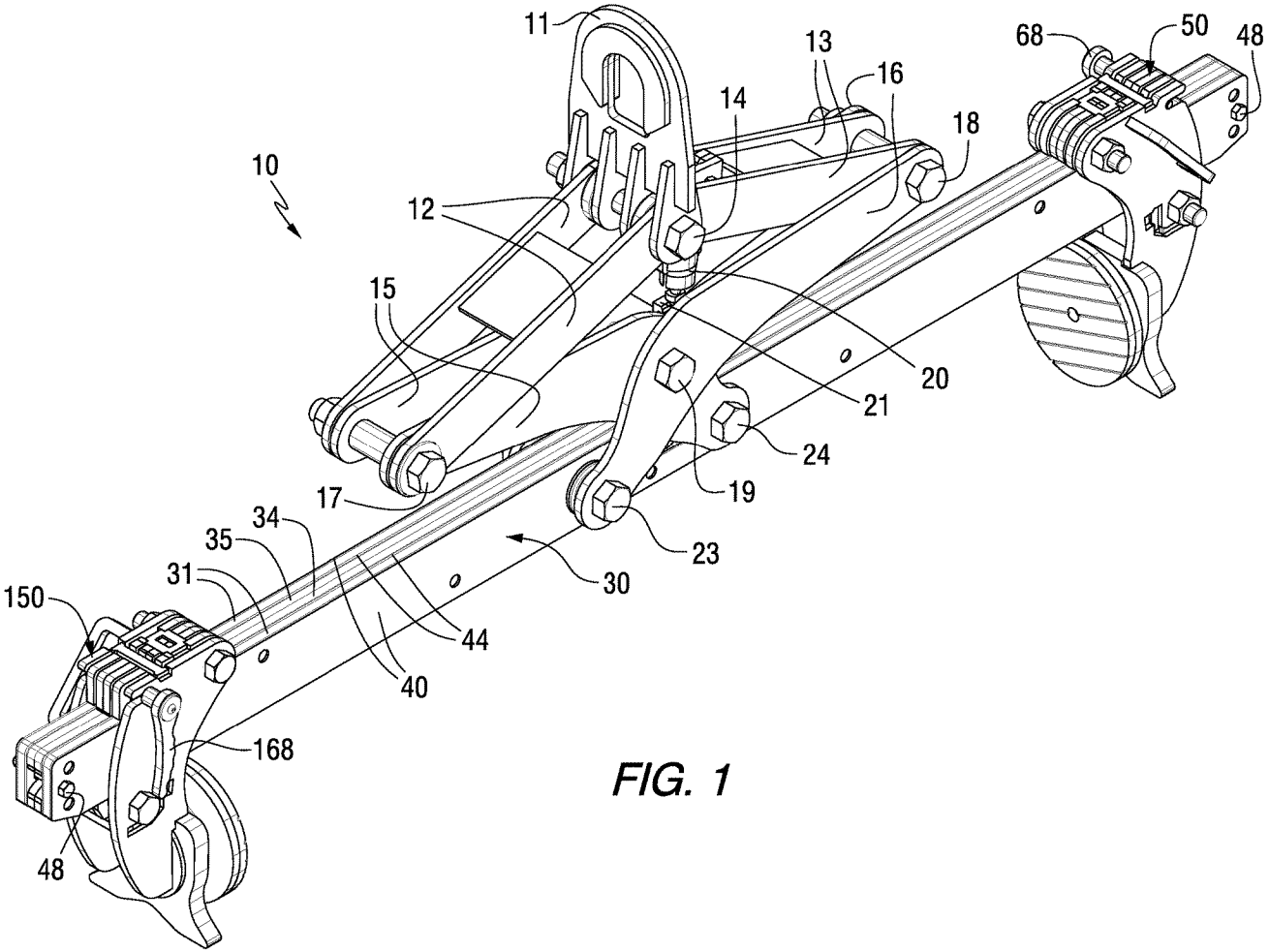
FIG. 1 is an isometric view of a lifting device in accordance with an embodiment of the present invention.

FIGS. 1-27 illustrate a lifting device 10 and various components thereof in accordance with an embodiment of the present invention. As shown in FIG. 1, the lifting device 10 includes a hook 11 that is pivotally connected to a set of upper arms 12 and another set of upper arms 13 via a central pivot bolt 14. A set of lower arms 15 are pivotally attached to the set of upper arms 12 by an outer pivot bolt 17. Another set of lower arms 16 are pivotally connected to the set of upper arms 13 by another outer pivot bolt 18. A central pivot bolt 19 pivotally connects the lower arms 15 to the lower arms 16 at an intermediate region along the lengths of the lower arms 15, 16. A latch 20 is connected to the upper arms set 13, and is releasingly securable in a latch keeper 21 mounted on the lower arm set 16. A lower bolt 23 provided at an end of the lower arms 16 is engaged with a spine assembly 30. Another lower bolt 24 located at an end of the lower arms set 15 is also engaged with the spine assembly 30.

As shown in FIG. 1, an outer foot 50 is mounted toward one end of the spine assembly 30, and an inner foot 150 is mounted toward the other end of the spine assembly 30. As more fully described below, the outer and inner feet 50 and 150 are manually movable along the length of the spine assembly 30 during lifting operations.

Figure 2:
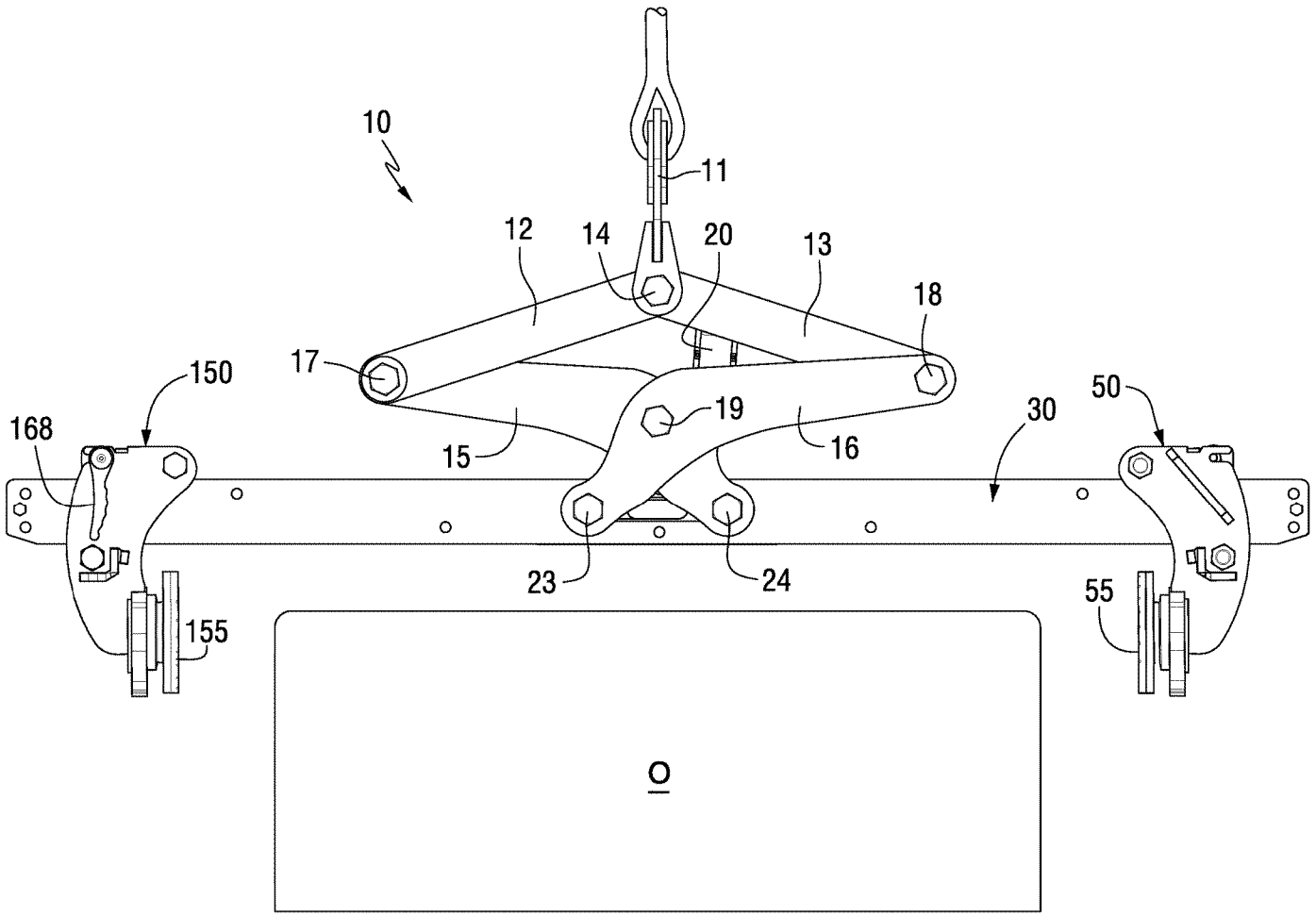
FIGS. 2-6 are side views of a lifting device in accordance with an embodiment of the present invention showing sequential steps during operation of the lifting device.
Figure 3:
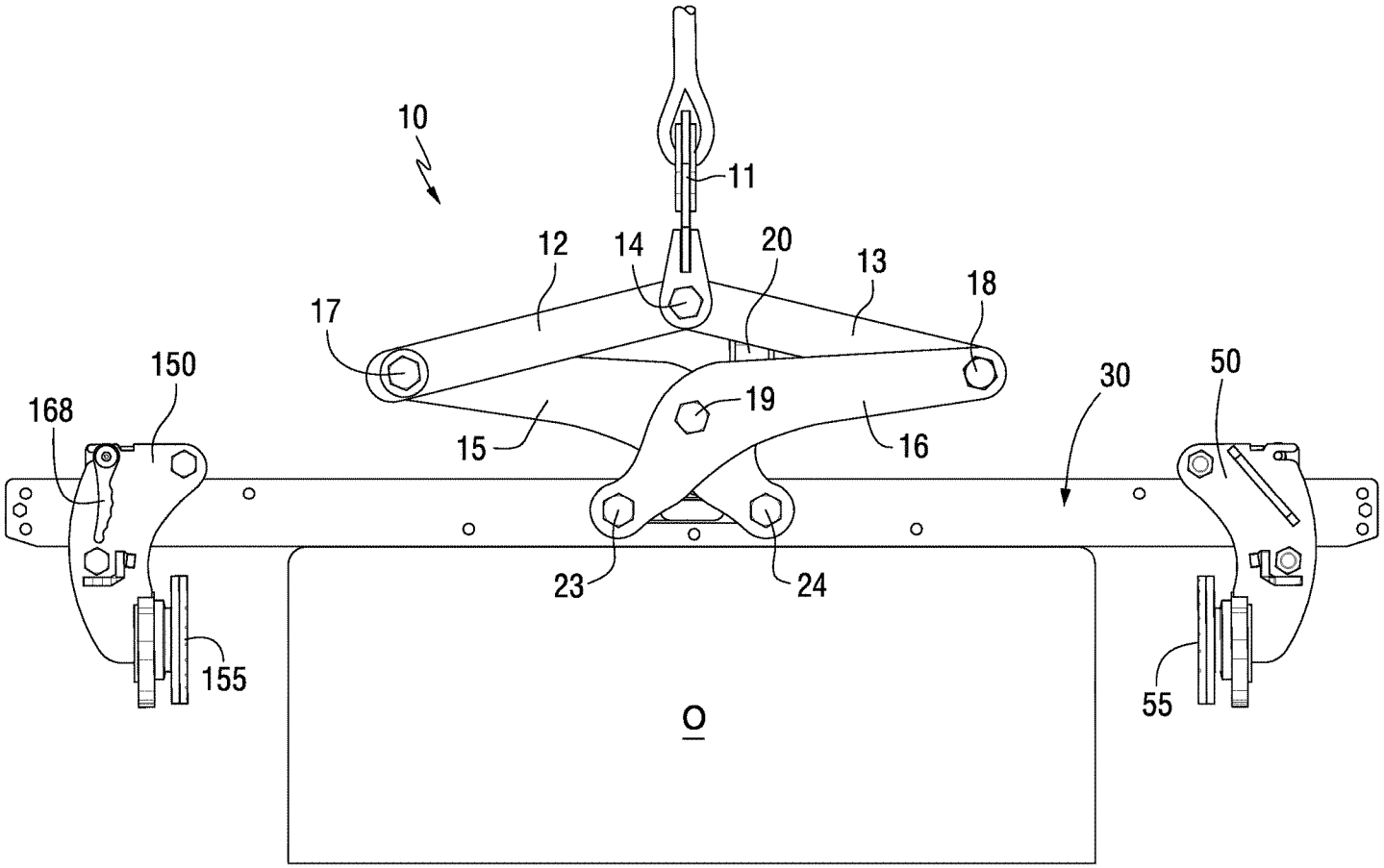

FIGS. 2-6 illustrate sequential steps during a lifting operation utilizing the lifting device 10. As shown in FIG. 2, the lifting device 10 is positioned above an object O to be lifted. The outer and inner feet 50 and 150 are positioned sufficiently far apart along the spine assembly 30 such that they easily clear the sides of the object O when the lifting device 10 is moved from an elevated position as shown in FIG. 2 to a lowered position as shown in FIG. 3, in which the spine assembly 30 of the lifting device 10 rests on the object O.

Figure 4:
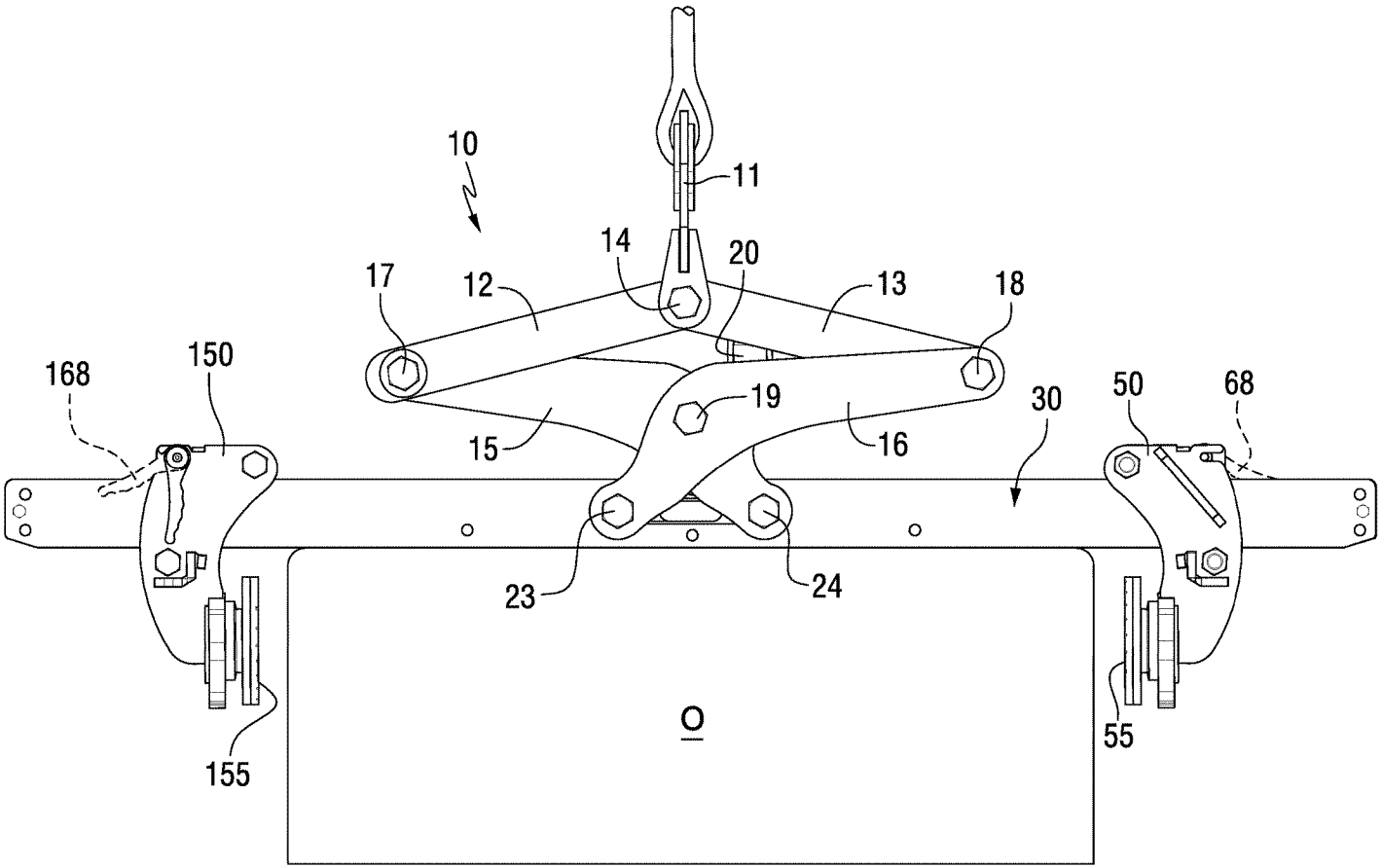

As shown in FIG. 4, the outer and inner feet 50 and 150 are then moved inwardly along the spine assembly 30 to positions in which their respective pads 55 and 155 are located relatively close to the sides of the object O. As shown in FIG. 4, cam handles 68 and 168 of the outer and inner feet 50 and 150 may be rotated to open positions, which allow the outer and inner feet 50 and 150 to freely slide along the spine assembly 30.

Figure 5:
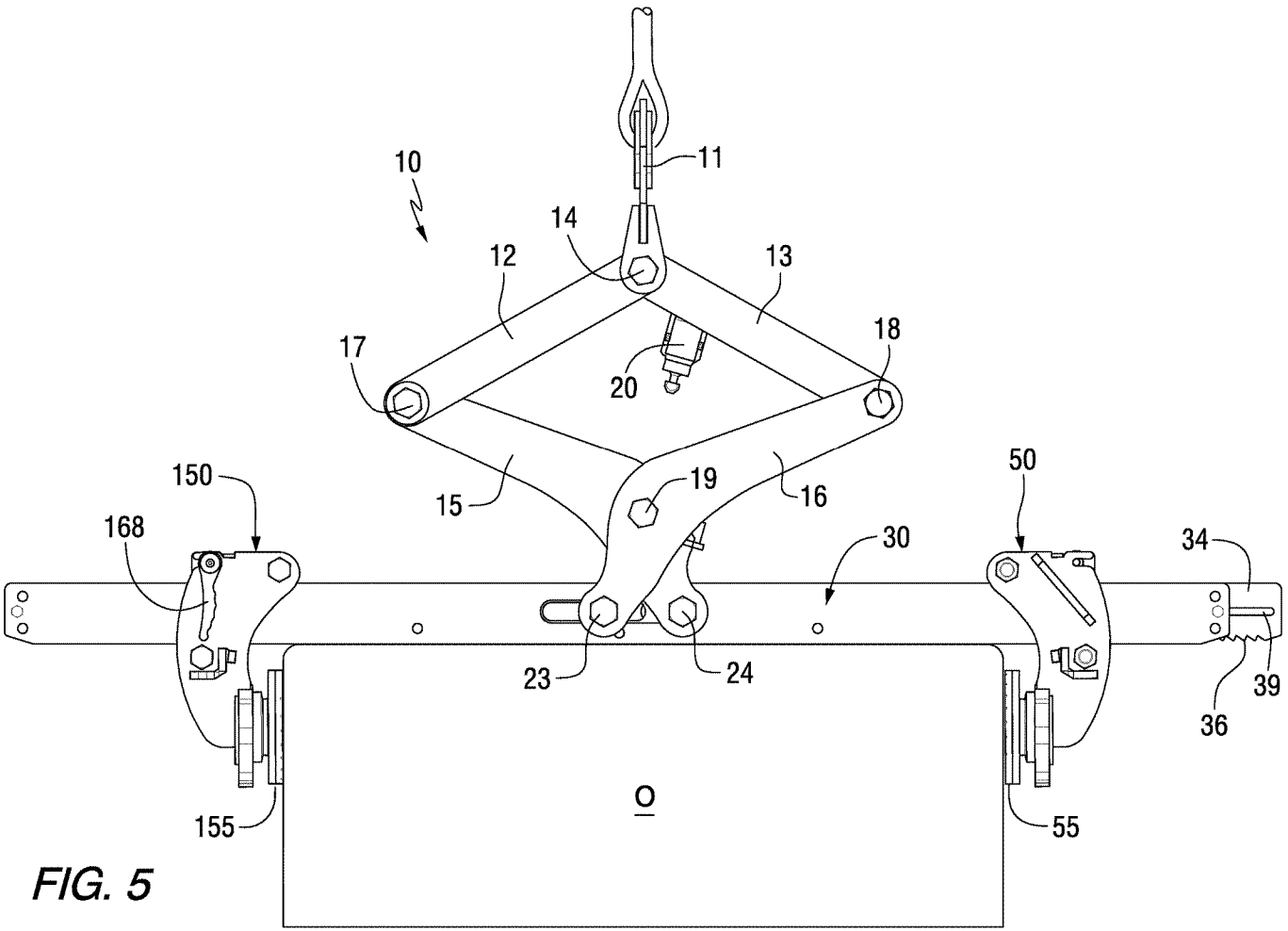

As shown in FIG. 5, when the latch 20 is disengaged and the hook 11 is raised, the inner foot 150 slides laterally along the spine assembly 30 while the outer foot 50 remains at a fixed location on the spine assembly 30. The object O is thereby clamped between the pads 55 and 155 of the outer and inner feet 50 and 150, enabling the object O to be lifted by the device 10.

Figure 6:
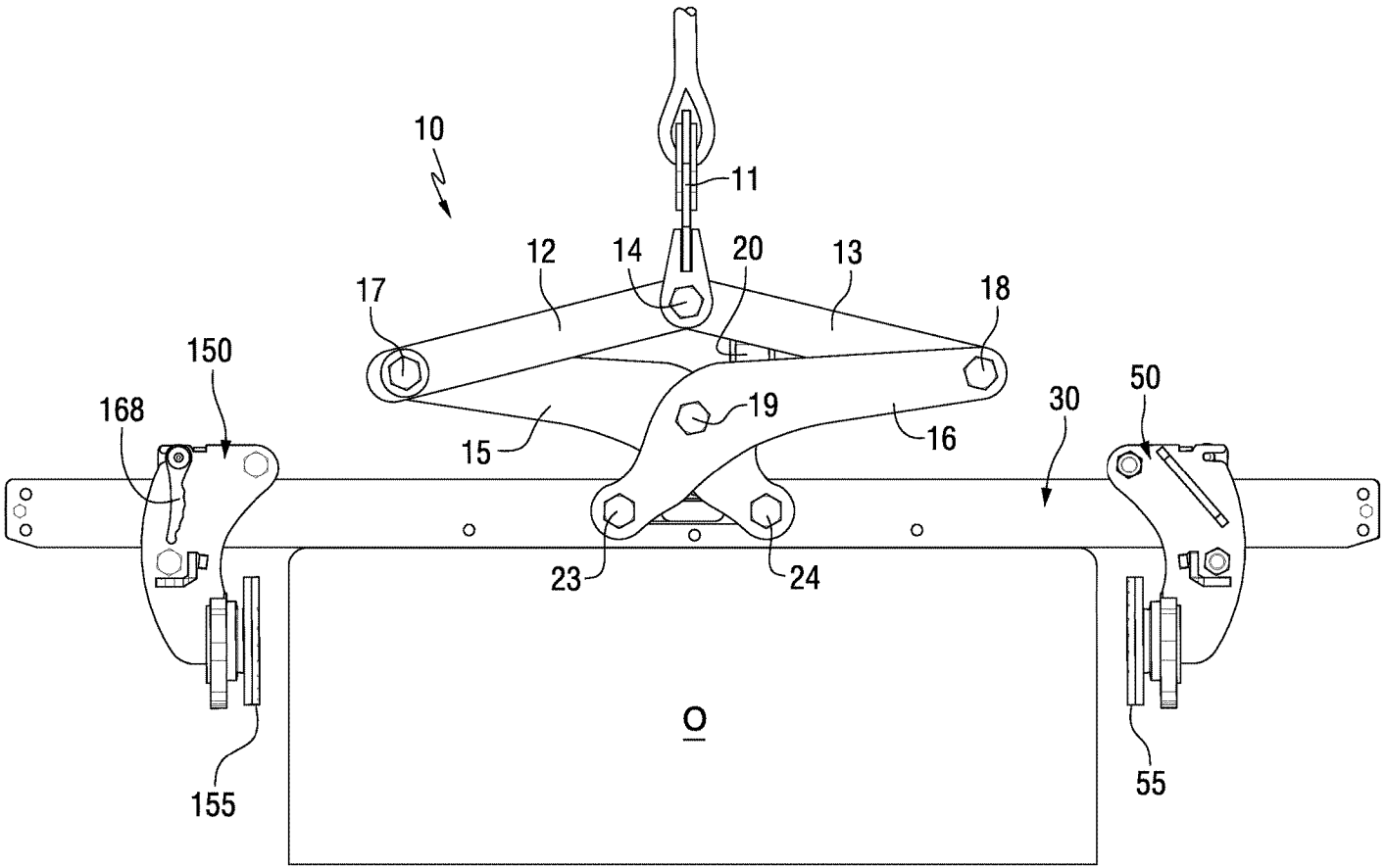

In the position shown in FIG. 6, the object O is unclamped by lowering the hook 11. As the hook 11 is lowered, the weight of the upper arms 12, 13 and lower arms 15, 16 causes rotation around the pivot bolts 14, 17, 18 and 19, which causes the lower bolts 23 and 24 to move away from each other along the length of the spine assembly 30. As more fully described below, such relative movement causes the inner foot 150 to move laterally along the spine 30 away from the outer foot 50 to thereby unclamp the object O. In this position, the latch 20 is engaged to fix the upper arms 13 and the lower arms 16 together, thereby locking the arms against relative rotation around the outer pivot bolt 18. The lifting device 10 may thus be lifted and removed from the object O while the upper arms 12, 13 and lower arms 15, 16 are locked together against relative rotational movement.

Figure 7:
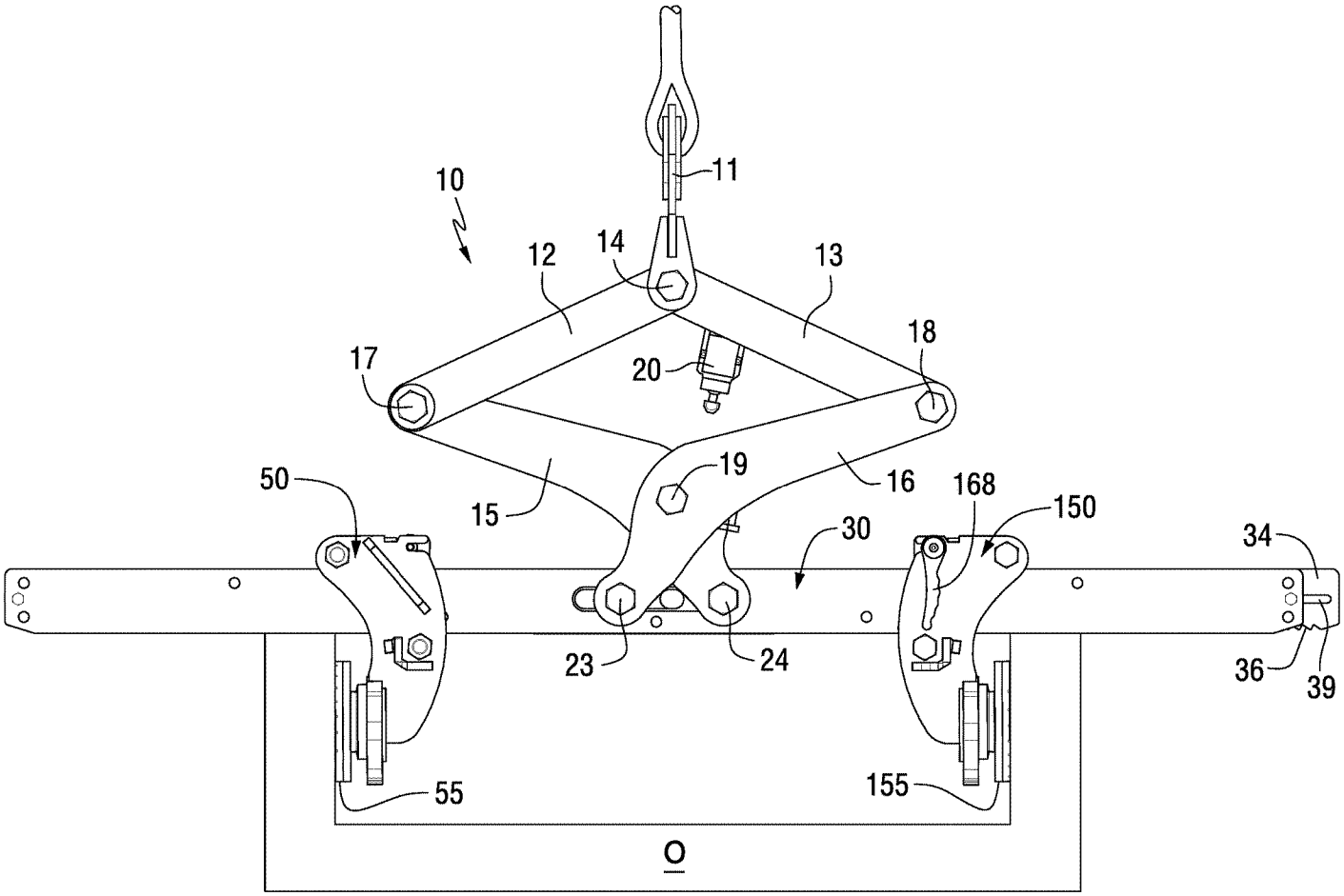
FIG. 7 is a side view of a lifting device in accordance with an embodiment of the present invention in which interior walls of an object to be lifted are contacted by the lifting device.

FIG. 7 illustrates an alternative lifting operation in which the outer and inner feet 50 and 150 of the lifting device 10 are positioned on the spine assembly 30 such that their respective pads 55 and 155 press against inside walls of the object O. For such a lifting operation, the positions of the outer and inner feet 50 and 150 are switched along the length of the spine assembly 30 in comparison with the configuration shown in FIGS. 2-6, and each of the outer and inner feet 50 and 150 are rotated 180 degrees around a vertical axis. In such positions, the pads 55 and 155 of the outer and inner feet 50 and 150 press outwardly against the inside walls of the object O when the hook 11 is lifted.

Figure 8:
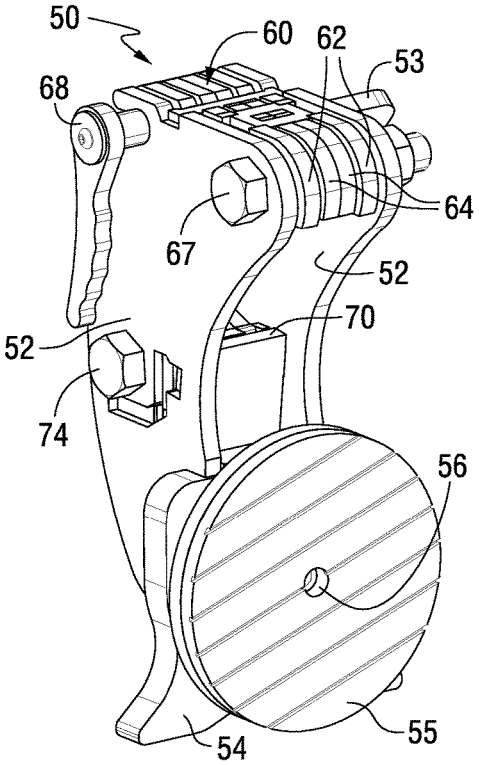
FIG. 8 is a front upper isometric view and FIG. 9 is a back upper isometric view of an outer foot of a lifting device in accordance with an embodiment of the present invention.
Figure 9:
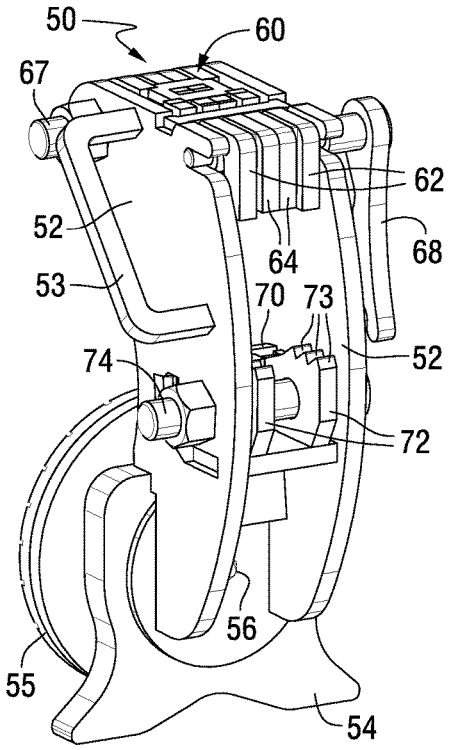
Figure 10:
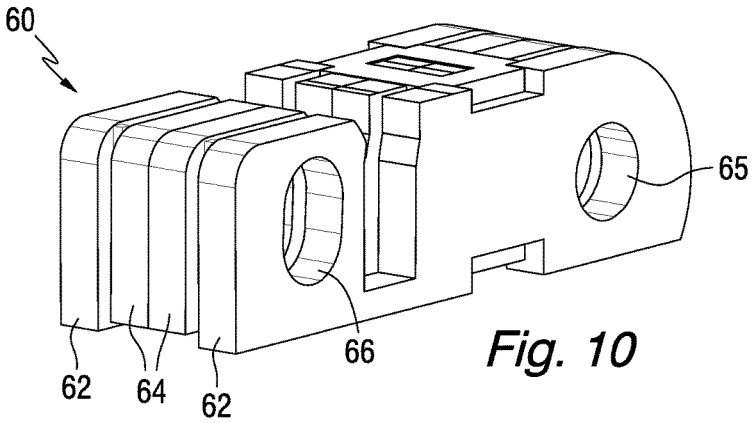
FIG. 10 is an isometric view of a shoe that is part of the outer foot assembly shown in FIGS. 8 and 9.
Figure 11:
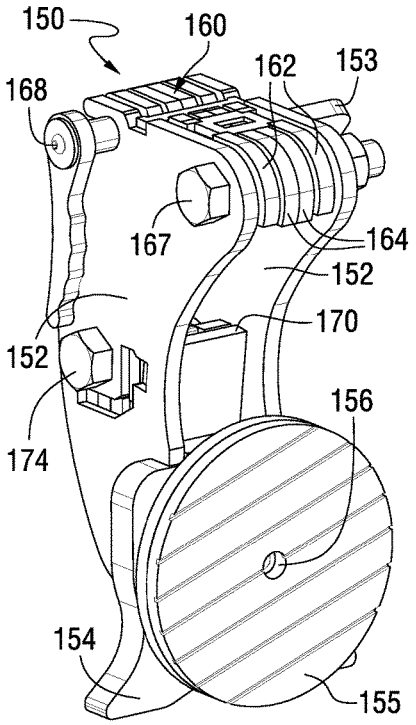
FIG. 11 is a front upper isometric view and FIG. 12 is a back upper isometric view of an inner foot of a lifting device in accordance with an embodiment of the present invention.
Figure 12:
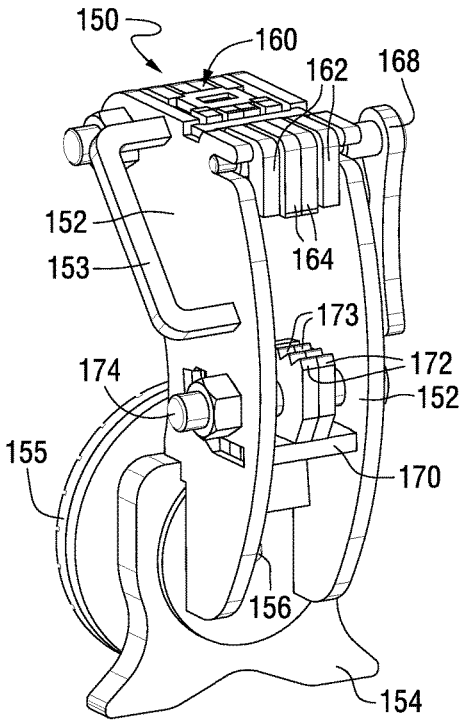
Figure 13:
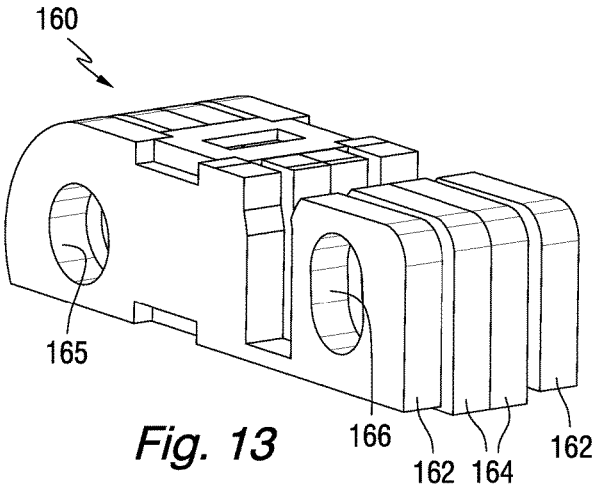
FIG. 13 is an isometric view of a shoe that is part of the inner foot shown in FIGS. 11 and 12.
Figure 14:
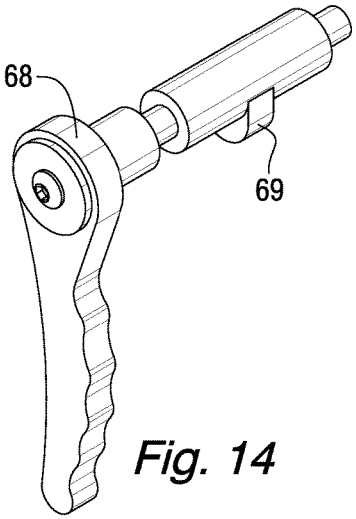
FIG. 14 is an isometric view of a cam handle used in outer and inner feet of a lifting device in accordance with an embodiment of the present invention.

FIGS. 8-10 illustrate details of the outer foot 50, and FIGS. 11-13 illustrate details of the inner foot 150, of the lifting device. As shown in FIGS. 8 and 9, the outer foot 50 includes two side plates 52 forming a shell having a pad mounting plate 54 secured thereto by any suitable means, such as welding, mechanical fasteners and the like. A pad 55 is mounted on the pad mounting plate 54 by a pivot mount assembly 56. As described in more detail below, the pivot mount assembly 56 allows the pad 55 to move in relation to the pad mounting plate 54 in order to adjust for uneven or non-parallel surfaces of objects O to be lifted. A fixed handle 53 is attached to one of the shell plates 52.

As shown in FIGS. 8-10, the outer foot 50 includes a shoe 60 including two outer extended plates 62 and two inner retracted plates 64. As described more fully below, the outer extended plates 62 extend downward further than the inner retracted plates 64 such that the outer extended plates 62 contact and are supported by outer spine bars 31 of the spine assembly 30. As shown most clearly in FIG. 10, the shoe 60 includes a circular bolt hole 65 extending laterally therethrough, and an oval-shaped cam hole 66 extending laterally therethrough at an opposite end from the bolt hole 65. As shown in FIGS. 8 and 9, a shoe bolt 67 extending between the shell plates 52 is received in the bolt hole 65 of the shoe 60 to thereby pivotally mount the shoe 60 inside the shell plates 52. As further shown in FIGS. 8 and 9, a cam handle 68 is rotatably mounted in the shell plates 52 of the outer foot 50. As shown in detail in FIG. 14, the cam handle 68 includes a cam 69 extending radially outward from the shaft of the cam handle 68.

As shown in FIGS. 8 and 9, a tooth block assembly 70 is mounted inside the outer foot 50 between the shell plates 52. The tooth block assembly 70 includes two tooth blocks 72 having upwardly extending teeth 73. A tooth block bolt 74 is used to secure the tooth blocks 72 in the tooth block assembly 70. As more fully described below, the tooth blocks 72 are spaced apart from each other along the length of the tooth block bolt 74 in order to align the teeth 73 of the tooth blocks 72 with corresponding teeth 32 of outer spine bars 31 of the spine assembly 30.

As shown in FIGS. 11 and 12, the outer foot 150 includes two side plates 152 forming a shell having a pad mounting plate 154 secured thereto by any suitable means, such as welding, mechanical fasteners and the like. A pad 155 is mounted on the pad mounting plate 154 by a pivot mount assembly 156. The pivot mount assembly 156 allows the pad 155 to move in relation to the pad mounting plate 154 in order to adjust for uneven or non-parallel surfaces of objects O to be lifted. A fixed handle 153 is attached to one of the shell plates 152.

As shown in FIGS. 11-13, the outer foot 150 includes a shoe 160 including two outer extended plates 162 and two inner retracted plates 164. As described more fully below, the outer extended plates 162 extend downward further than the inner retracted plates 164 such that the outer extended plates 162 contact and are supported by outer spine bars 131 of the spine assembly 130. As shown most clearly in FIG. 13, the shoe 160 includes a circular bolt hole 165 extending laterally therethrough, and an oval-shaped cam hole 166 extending laterally therethrough at an opposite end from the bolt hole 165. A shoe bolt 167 extends between the shell plates 152 and is received in the bolt hole 165 of the shoe 160 to thereby pivotally mount the shoe 160 inside the shell plates 152. As shown in FIGS. 11 and 12, a cam handle 168 is rotatably mounted in the shell plates 152 of the outer foot 150. The cam handle 168 includes a radially outwardly extending cam similar to the cam 69 shown in FIG. 14.

Figure 17:
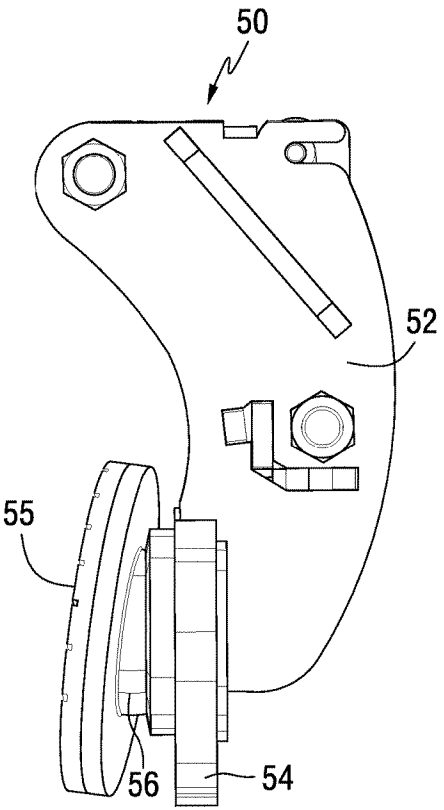
FIGS. 15-17 are side views of an outer foot of a lifting device, illustrating adjustable positioning of a pad.
Figure 16:
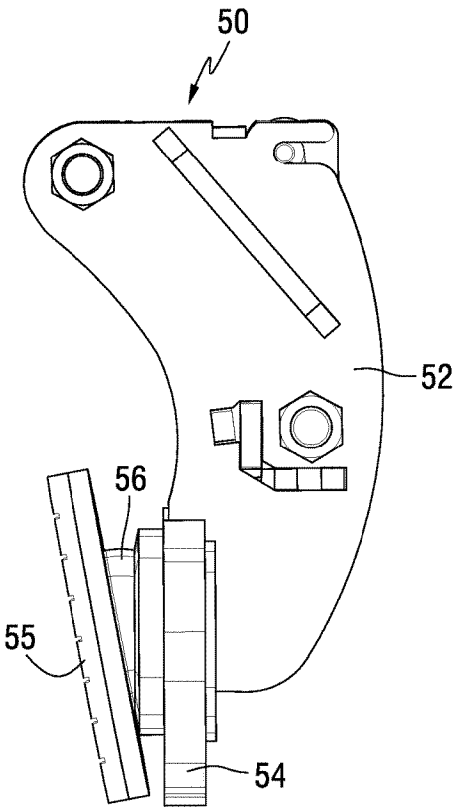
Figure 15:
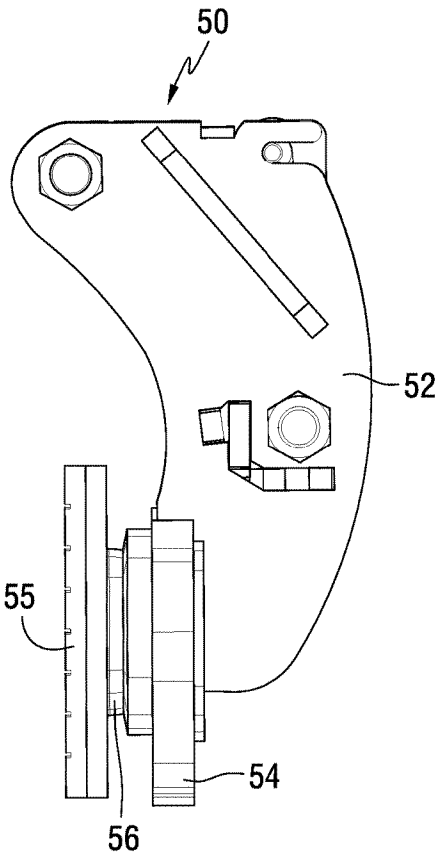

FIGS. 15-17 illustrate the ability of the pad 55 to pivotally adjust with respect to the pad mounting plate 54 of the outer foot 50 using the pivot mount assembly 56 in accordance with an embodiment of the present invention. In FIG. 15, the contact surface of the pad 55 is in a vertical plane suitable for lifting objects with vertical side walls. In FIG. 16, the contact surface of the pad 55 is in a non-vertical plane, to allow the pad 55 to adjust to non-vertical surfaces of objects to be lifted. In FIG. 17, the contact surface of the pad 55 is pivoted to a non-vertical plane that is also twisted in relation to the pad mounting plate 54. In accordance with embodiments of the present invention, the pivot mount assembly 56 may be of any suitable configuration known to those skilled in the art, for example, a ball and socket joint, a universal joint, a loose bolt assembly and the like.

Figure 18:
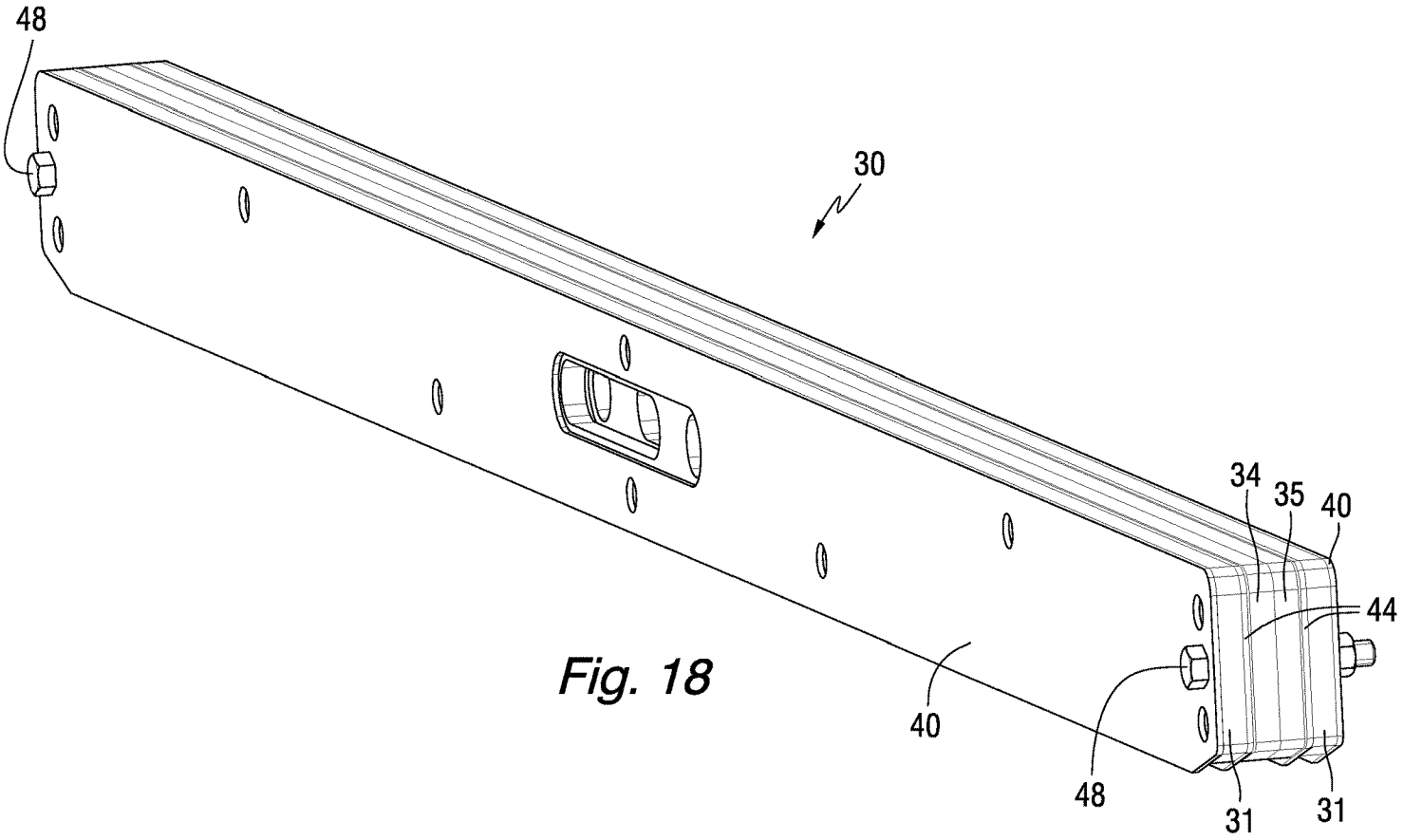
FIG. 18 is an isometric view of a spine assembly of a lifting device in accordance with an embodiment of the present invention.

FIGS. 18-23 illustrate details of the spine assembly 30 in accordance with an embodiment of the present invention. As shown in FIG. 18, the spine assembly 30 includes two outer spine bars 31, a first inner spine bar 34, and a second inner spine bar 35. Outer spine scab plates 40 are located adjacent to the outer spine bars 31 and form opposed exterior side surfaces of the spine assembly 30. Inner spine scab plates 44 are located on opposite surfaces of the first and second inner spine bars 34 and 35, inside of the outer spine bars 31. End bolts 48 are used to secure the outer spine bars 31, first and second inner spine bars 34 and 35, outer spine scab plates 40, and inner spine scab plates 44 together in a manner that allows the first and second inner spine bars 34 and 35 to slide in relation to the outer spine bars 31 in a direction along the length of the spine assembly 30.

Figure 19:
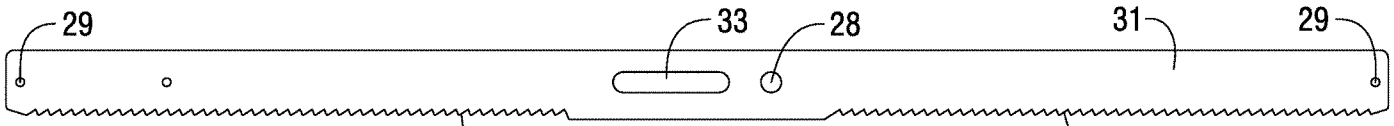
FIGS. 19-23 are side views of spine bars and spine scab plates of the spine assembly shown in FIG. 18.

FIG. 19 illustrates an outer spine bar 31 of the spine assembly 30. The outer spine bar 31 includes downwardly extending teeth 32 that are structured and arranged to engage the upwardly extending teeth 73 of the tooth blocks 72 contained in the outer foot 50. As shown in FIG. 19, a slot 33 is provided in the outer spine bar 31, which receives the lower bolt 23 located at the end of the lower arms 16 of the lifting device 10. A central bolt hole 28, is also provided through the outer spine bar 31 for receiving the lower bolt 24 located at the end of the lower arms 15 of the lifting device 10. End holes 29 are provided near the ends of the outer spine bar 31 for receiving the end bolts 48 of the spine assembly 30.

Figure 20:
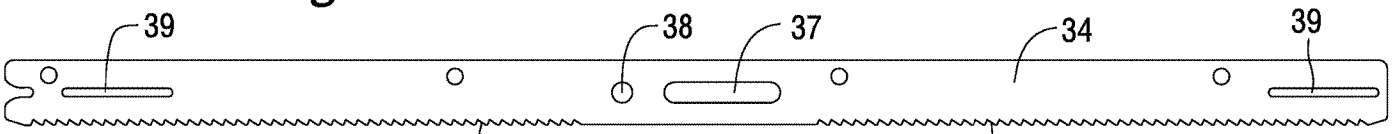

FIG. 20 illustrates the first inner spine bar 34 of the spine assembly 30. The first inner spine bar 34 includes downwardly extending teeth 36 that are structured and arranged to engage the upwardly extending teeth 173 of the tooth block 172 in the inner foot 150. The first inner spine bar 34 includes a central slot 37 through which the lower bolt 24 at the end of the lower arms 16 is slidingly engaged. The first inner spine bar 34 also includes a central hole 38 through which the lower bolt 23 at the end of the lower arms 16 extends. End slots 39 are provided near the ends of the first inner spine bar 34 for slidingly receiving the end bolts 48 of the spine assembly 30.

Figure 21:
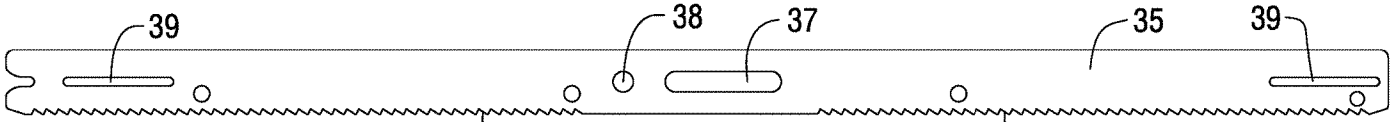

FIG. 21 illustrates the second inner spine bar 35 of the spine assembly 30. The second inner spine bar 35 includes downwardly extending teeth 36 structured and arranged to engage with the upwardly extending teeth 173 of the tooth block 172 in the inner foot 150. The second inner spine bar 35 also includes a central slot 37, central hole 38, and end slots 39 similar to those of the first inner spine bar 34.

Figure 22:
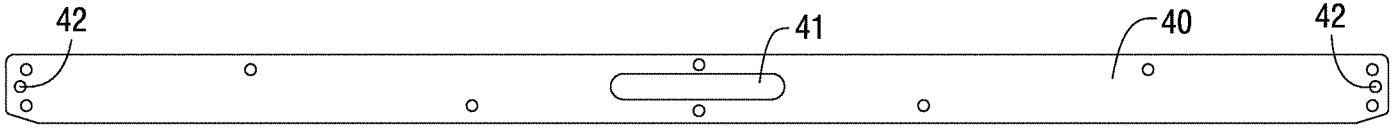

FIG. 22 illustrates an outer spine scab plate 40 of the spine assembly 30. The outer spine scab plate 40 includes a central slot 41 through which the lower bolts 23 and 24 of the lifting device 10 are slidingly engaged. End holes 42 near the ends of the outer spine scab plate 40 receive the end bolts 48 of the spine assembly 30.

Figure 23:
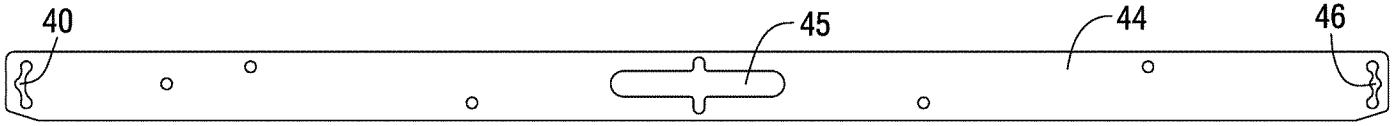

FIG. 23 illustrates an inner spine scab plate 44 of the spine assembly 30. The inner spine scab plate 44 includes a central slot 45 through which the lower bolts 23 and 24 of the lifting device 10 extend and are slidingly engaged. End holes 46 near the ends of the inner spine scab plate 44 receive the end bolts 48 of the spine assembly 30.

Figure 24:
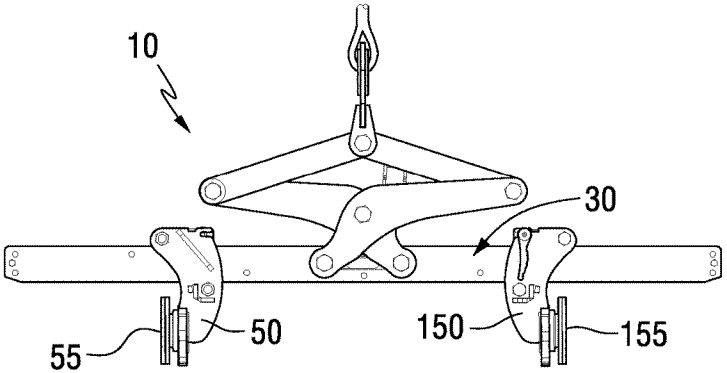

FIGS. 24-27 illustrate alternative lifting configurations for the lifting device 10 in accordance with embodiments of the present invention. In FIG. 24, the outer and inner feet 50 and 150 are positioned on the spine assembly 30 with their respective pads 55 and 155 facing outwardly. In this configuration, similar to that shown in FIG. 7, the lifting device 10 may be used to engage interior walls of an object O to be lifted.

Figure 25:
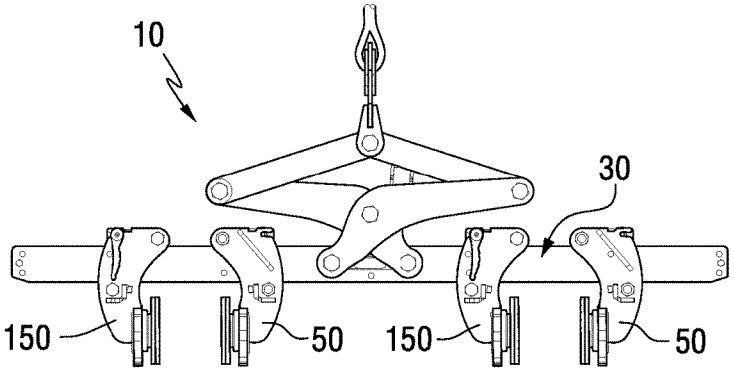
FIGS. 24-27 are side views illustrating different lifting configurations for lifting devices in accordance with embodiments of the present invention.

In FIG. 25, two pairs of outer and inner feet 50 and 150 are used to clamp against both interior and exterior walls of an object to be lifted.

Figure 26:
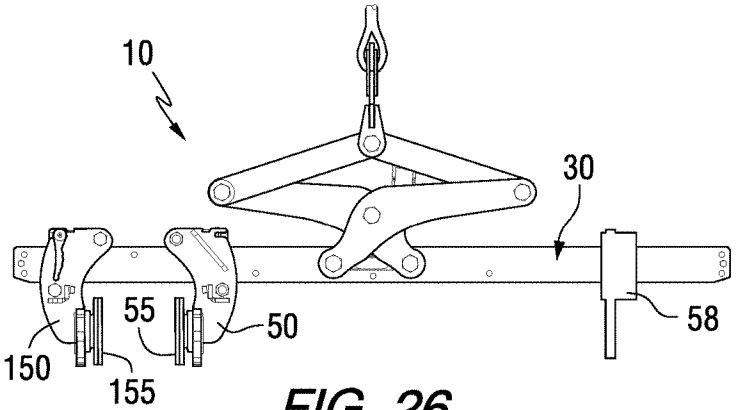

In FIG. 26, the outer and inner feet 50 and 150 are provided on one side of the spine assembly 30, and a counterweight hook 58 is provided on the other side of the spine assembly 30. In this configuration, relatively narrow objects may be lifted using one side of the spine assembly 30 while counter balancing the weight of the object with an appropriate amount of weight hung from the counterweight 58.

Figure 27:
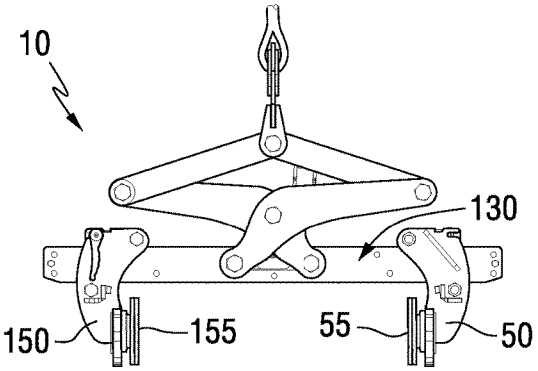

In FIG. 27, the relatively long spine assembly 30 is replaced with a relatively short spine assembly 130 in order to lift narrower objects. The short spine assembly 130 includes similar components as the longer spine assembly 30.

The components of the lifting device 10 may be made of any suitable materials known to those skilled in the art, including metals such as steel.

As used herein, "including," "containing" and like terms are understood in the context of this application to be synonymous with "comprising" and are therefore open-ended and do not exclude the presence of additional undescribed or unrecited elements, materials, phases or method steps. As used herein, "consisting of" is understood in the context of this application to exclude the presence of any unspecified element, material, phase or method step. As used herein, "consisting essentially of" is understood in the context of this application to include the specified elements, materials, phases, or method steps, where applicable, and to also include any unspecified elements, materials, phases, or method steps that do not materially affect the basic or novel characteristics of the invention.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. In this application and the appended claims, the articles "a," "an," and "the" include plural referents unless expressly and unequivocally limited to one referent.

Whereas particular embodiments of this invention have been described above for purposes of illustration, it will be evident to those skilled in the art that numerous variations of the details of the present invention may be made without departing from the invention as defined in the appended claims.

What is claimed is:

1. A lifting device comprising a lifting hook;

first and second upper arms comprising ends pivotally connected to the lifting hook, and lower ends;

first and second lower arms having upper ends pivotally connected to the lower ends of the first and second upper arms, a central pivot bolt pivotally connecting the first and second lower arms together at intermediate regions thereof, and lower ends movable toward and away from each other when the first and second arms rotate in relation to each other around the central pivot bolt;

a spine assembly supported by the lower ends of the first and second lower arms; and outer and inner feet mounted at different positions along a length of the spine assembly and comprising pads structured and arranged to grip objects to be lifted by the lifting device, wherein the spine assembly comprises outer and inner spine bars slidably movable in relation to each other along the length of the spine assembly when the lower ends of the first and second lower arms are moved toward and away from each other, the outer foot is releasingly securable to the outer spine bar, and the inner foot is releasingly securable to the inner spine bar, whereby the sliding movement of the outer and inner spine bars in relation to each other causes the outer and inner feet to move in relation to each other along the length of the spine assembly, wherein the outer spine bar comprises downwardly extending teeth on a lower edge thereof engagable with upwardly extending teeth of an outer tooth block located inside the outer foot, and the inner spine bar comprises downwardly extending teeth on a lower edge thereof engageable with upwardly extending teeth of an inner tooth block located inside the inner foot, wherein the outer foot comprises an outer shoe comprising a lower edge slidingly supported on an upper edge of the outer spine bar, and the inner foot comprises an inner shoe comprising a lower edge slidingly supported on an upper edge of the inner spine bar, and wherein opposing shell plates of the outer foot are downwardly movable in relation to the outer shoe, the outer tooth block is fixedly secured to the opposing shell plates of the outer foot, and downward movement of the opposing shell plates of the outer foot in relation to the outer shoe causes the outer tooth block to drop in relation to the downwardly extending teeth of the outer spine bar to thereby disengage the downwardly extending teeth from the upwardly extending teeth of the outer tooth block.

2. The lifting device of claim 1, further comprising a cam handle rotatably mounted on the shell plates of the outer foot and having a cam located in a cam hole extending through the outer shoe, whereby rotation of the cam handle causes the cam to contact the cam hole and move the opposing shell plates of the outer foot upward or downward in relation to the outer shoe.

3. The lifting device of claim 2, wherein the cam hole is located adjacent to an end of the outer shoe, the outer shoe comprises a generally cylindrical bolt hole at an end thereof opposite from the cam hole, and an outer shoe bolt extends between the shell plates through the cam hole to rotatably mount the outer shoe on the shell plates.

4. The lifting device of claim 1, wherein the spine assembly comprises two of the outer spine bars located on opposite sides of the inner spine bar, and the outer tooth block comprises two sets of upwardly extending teeth vertically aligned with the downwardly extending teeth of the two outer spine bars.

5. The lifting device of claim 1, wherein opposing shell plates of the inner foot are downwardly moveable in relation to the inner shoe, the inner tooth block is fixedly secured to the opposing shell plates of the inner foot, and downward movement of the opposing shell plates of the inner foot in relation to the inner shoe causes the inner tooth block to drop in relation to the downwardly extending teeth of the inner spine bar to thereby disengage the downwardly extending teeth from the upwardly extending teeth of the inner tooth block.

6. The lifting device of claim 5, further comprising a cam handle rotatably mounted on the opposing shell plates of the inner foot and having a cam located in a cam hole extending through the inner shoe, whereby rotation of the cam handle causes the cam to contact the cam hole and move the shell plates of the inner foot upward or downward in relation to the inner shoe.

7. The lifting device of claim 6, wherein the cam hole is located adjacent to an end of the inner shoe, the inner shoe comprises a generally cylindrical bolt hole at an end thereof opposite from the cam hole, and an inner shoe bolt extends between the shell plates through the cam hole to rotatably mount the inner shoe on the shell plates.

8. The lifting device of claim 7, wherein the spine assembly comprises two of the inner spine bars located inside of two of the outer spine bars, and the inner tooth block comprises two sets of upwardly extending teeth vertically aligned with the downwardly extending teeth of the two inner spine bars.

9. The lifting device of claim 1, wherein the outer spine bar comprises a central slot receiving a first bolt connected to the lower end of the first lower arm, and a central hole receiving a second bolt connected to the lower end of the second lower arm, and wherein the inner spine bar comprises a central hole receiving the first bolt, and a central slot receiving the second bolt.

10. The lifting device of claim 9, further comprising end bolts at opposite ends of the spine assembly, wherein each end bolt extends through an end hole located at an end of the outer spine bar, and each end bolt extends through an end slot located at an end of the inner spine bar.

11. The lifting device of claim 1, further comprising a latch structured and arranged to selectively lock the first and second upper arms against relative movement with the first and second lower arms.

12. The lifting device of claim 1, wherein the pads are pivotally mounted on the outer and inner feet.

13. The lifting device of claim 1, wherein the outer and inner feet are reversibly mountable on the spine assembly.

14. A lifting device comprising a lifting hook;

first and second upper arms comprising ends pivotally connected to the lifting hook, and lower ends;

first and second lower arms having upper ends pivotally connected to the lower ends of the first and second upper arms, a central pivot bolt pivotally connecting the first and second lower arms together at intermediate regions thereof, and lower ends movable toward and away from each other when the first and second arms rotate in relation to each other around the central pivot bolt;

a spine assembly supported by the lower ends of the first and second lower arms; and outer and inner feet mounted at different positions along a length of the spine assembly and comprising pads structured and arranged to rip objects to be lifted by the lifting device, wherein the spine assembly comprises outer and inner spine bars slidably movable in relation to each other along the length of the spine assembly when the lower ends of the first and second lower arms are moved toward and away from each other, the outer foot is releasingly securable to the outer spine bar, and the inner foot is releasingly securable to the inner spine bar, whereby the sliding movement of the outer and inner spine bars in relation to each other causes the outer and inner feet to move in relation to each other along the length of the spine assembly, wherein the outer spine bar comprises downwardly extending teeth on a lower edge thereof engageable with upwardly extending teeth of an outer tooth block located inside the outer foot, and the inner spine bar comprises downwardly extending teeth on a lower edge thereof engageable with upwardly extending teeth of an inner tooth block located inside the inner foot, wherein the outer foot comprises an outer shoe comprising a lower edge slidingly supported on an upper edge of the outer spine bar, and the inner foot comprises an inner shoe comprising a lower edge slidingly supported on an upper edge of the inner spine bar, and wherein opposing shell plates of the inner foot are downwardly moveable in relation to the inner shoe, the inner tooth block is fixedly secured to the opposing shell plates of the inner foot, and downward movement of the opposing shell plates of the inner foot in relation to the inner shoe causes the inner tooth, block to drop in relation to the downwardly extending teeth of the inner spine bar to thereby disengage the downwardly extending teeth from the upwardly extending teeth of the inner tooth block.

15. A lifting device comprising a lifting hook;

first and second upper arms comprising ends pivotally connected to the lifting hook, and lower ends;

first and second lower arms having upper ends pivotally connected to the lower ends of the first and second upper arms, a central pivot bolt pivotally connecting the first and second lower arms together at intermediate regions thereof, and lower ends movable toward and away from each other when the first and second arms rotate in relation to each other around the central pivot bolt;

a spine assembly supported by the lower ends of the first and second lower arms; and outer and inner feet mounted at different positions along a length of the spine assembly and comprising pads structured and arranged to grip objects to be lifted by the lifting device, wherein the spine assembly comprises outer and inner spine bars slidably movable in relation to each other along the length of the spine assembly when the lower ends of the first and second lower arms are moved toward and away from each other, the outer foot is releasingly securable to the outer spine bar, and the inner foot is releasingly securable to the inner spine bar, whereby the sliding movement of the outer and inner spine bars in relation to each other causes the outer and inner feet to move in relation to each other along the length of the spine assembly, wherein the outer spine bar comprises a central slot receiving a first bolt connected to the lower end of the first lower arm, and a central hole receiving a second bolt connected to the lower end of the second lower arm, and wherein the inner sine bar comprises a central hole receiving the first bolt, and a central slot receiving the second bolt, and further comprising end bolts at opposite ends of the spine assembly, wherein each end bolt extends through an end hole located at an end of the outer spine bar, and each end bolt extends through an end slot located at an end of the inner spine bar.

* * * * *